US008191340B1

(12) United States Patent
Buchko

(10) Patent No.: US 8,191,340 B1
(45) Date of Patent: Jun. 5, 2012

(54) MANDREL BRAKE ARRANGEMENT FOR A WEB SUPPLY IN A PACKAGING MACHINE

(75) Inventor: Raymond G. Buchko, Neenah, WI (US)

(73) Assignee: CP Packaging, Inc., Appleton, WI (US)

( * ) Notice: Subject to any disclaimer, the term of this patent is extended or adjusted under 35 U.S.C. 154(b) by 84 days.

(21) Appl. No.: 12/333,042

(22) Filed: Dec. 11, 2008

(51) Int. Cl.
*B65B 41/00* (2006.01)

(52) U.S. Cl. ..... 53/389.4; 53/389.2; 242/571.1

(58) Field of Classification Search ..... 53/389.1–389.4; 242/571.1, 571.2, 530.3, 422.2, 396.8
See application file for complete search history.

(56) References Cited

U.S. PATENT DOCUMENTS

| | | | | | |
|---|---|---|---|---|---|
| 862,997 | A | | 8/1907 | Riley, Jr. et al. | |
| 3,815,841 | A | | 6/1974 | Wolff | |
| 3,904,143 | A | * | 9/1975 | Kullander | 242/571.2 |
| 3,904,144 | A | * | 9/1975 | Gattrugeri | 242/571.2 |
| 4,209,140 | A | | 6/1980 | Seibert | |
| 4,347,962 | A | * | 9/1982 | Uphues | 226/195 |
| 4,610,407 | A | | 9/1986 | Stubbmann | |
| 4,660,781 | A | | 4/1987 | Hazard | |
| 4,664,332 | A | | 5/1987 | Barazone | |
| 4,682,741 | A | | 7/1987 | Honegger | |
| 4,693,431 | A | * | 9/1987 | Kataoka | 242/413.1 |
| 5,170,611 | A | | 12/1992 | Buchko et al. | |
| 5,205,110 | A | | 4/1993 | Buchko | |
| 5,445,342 | A | * | 8/1995 | Miller et al. | 242/571.2 |
| 5,451,010 | A | * | 9/1995 | Heuser | 242/530.3 |
| 5,511,713 | A | | 4/1996 | Sakaguchi et al. | |
| 5,524,834 | A | | 6/1996 | Bogucki-Land | |
| 5,538,200 | A | | 7/1996 | Tatum | |
| 5,785,270 | A | | 7/1998 | Buchko | |
| 5,803,399 | A | * | 9/1998 | Hashikawa | 242/576.1 |
| 5,934,605 | A | * | 8/1999 | Marin | 242/571.2 |
| 6,079,662 | A | * | 6/2000 | Miller et al. | 242/571.2 |
| 6,196,494 | B1 | * | 3/2001 | Rollins et al. | 242/571.2 |
| 6,599,224 | B2 | * | 7/2003 | Magnani | 492/47 |

* cited by examiner

*Primary Examiner* — Thanh Truong
(74) *Attorney, Agent, or Firm* — Boyle Fredrickson, S.C.

(57) ABSTRACT

A mandrel for supporting a roll of flexible web material has a brake mounted thereto that can be selectively activated to apply a braking force to rotation of the roll of flexible material about the mandrel. The brake includes an inflatable bladder and a shoe, such that when the bladder is inflated the shoe is pushed into engagement with the core of the roll of flexible material. The mandrel is particularly well suited for use with a packaging machine in which a sheet of flexible material is indexed form the supply roll. Before the completion of an indexing cycle, the bladder may be inflated such that further advancement of the sheet of flexible material or rotation of the supply roll is countered and inhibited. This braking of the supply roll advantageously introduces tension to the sheet of flexible material without the use of a dancer roll arrangement.

8 Claims, 7 Drawing Sheets

MANDREL BRAKE ARRANGEMENT FOR A WEB SUPPLY IN A PACKAGING MACHINE

BACKGROUND AND SUMMARY OF THE INVENTION

This invention relates to packaging equipment or machines, and more particularly to a web supply arrangement incorporated in a packaging machine.

A packaging machine typically includes at least one web supply arrangement from which a web of packaging material is supplied to the components of the packaging machine from a supply roll. Typically, the edges of the web are gripped, such as by a gripper assembly, that advances the web through the various stations of the packaging machine.

It has been known to provide a desired degree of tension in the web, between the supply roll and the web advancement mechanism, using a dancer roll arrangement. In such an arrangement, the web is trained about one or more dancer rolls in a serpentine path, and the dancer rolls move so as to take up slack in the web and thereby provide a certain degree of tension in the web. While this arrangement functions satisfactorily, it can be undesirable in that the seal surface of the web comes into contact with one or more of the dancer roll surfaces. Since the seal surface of the web is the surface that faces or contacts the package product, this contact of the seal surface with the dancer rolls can be particularly undesirable in a food or pharmaceutical packaging application. While unlikely, it is possible that contaminants may be transferred to the seal surface of the web from the dancer roll surfaces. Furthermore, the dancer roll arrangement requires a certain length of the web material to be exposed to atmosphere before the package is formed. Again, while unlikely, this provides a potential for contaminants to come into contact with the seal surface of the web.

It is therefore an object of the present invention to provide a packaging machine which eliminates the necessity for a dancer roll arrangement to maintain tension in the web prior to engagement of the web with the advancement mechanism of the packaging machine. It is a further object of the invention to provide a packaging machine in which the seal surface of the web does not come into contact with any components of the machine before the web is engaged with the advancement mechanism of the packaging machine. It is a further object of the invention to provide such a packaging machine which reduces the length of the web that is exposed to atmosphere between the supply roll and the web advancement mechanism.

The present invention contemplates a web supply arrangement in which tension is created in the web of packaging material without the use of dancer rolls. Thus, the seal surface of the web material does not come into contact with any component of the packaging machine as the web material is advanced from the web supply roll to a formation station at which cavities are formed in the web material for the subsequent placement of food or other products. In accordance with one embodiment of the present invention, the packaging machine includes a mandrel that supports a roll of web material. The mandrel includes a shaft designed to extend through a hollow core of a roll of web material, which is adapted to rotate around the shaft as web material is advanced from the roll of web material. A bladder is associated with the shaft, and is selectively inflatable to apply pressure against the hollow core to slow rotation of the roll of web material around the shaft. The mandrel may include a shoe slidably coupled to the shaft and configured to engage the hollow core of the roll of web material when the bladder is inflated.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

The present application will be described with respect to a food packaging machine, but it is understood that the invention may also be applicable with other food handling machines as well as non-food handling systems, such as packaging systems for packaging pharmaceutical products or any other product that is suitable for packaging between a pair of sealed webs.

Figure 1:
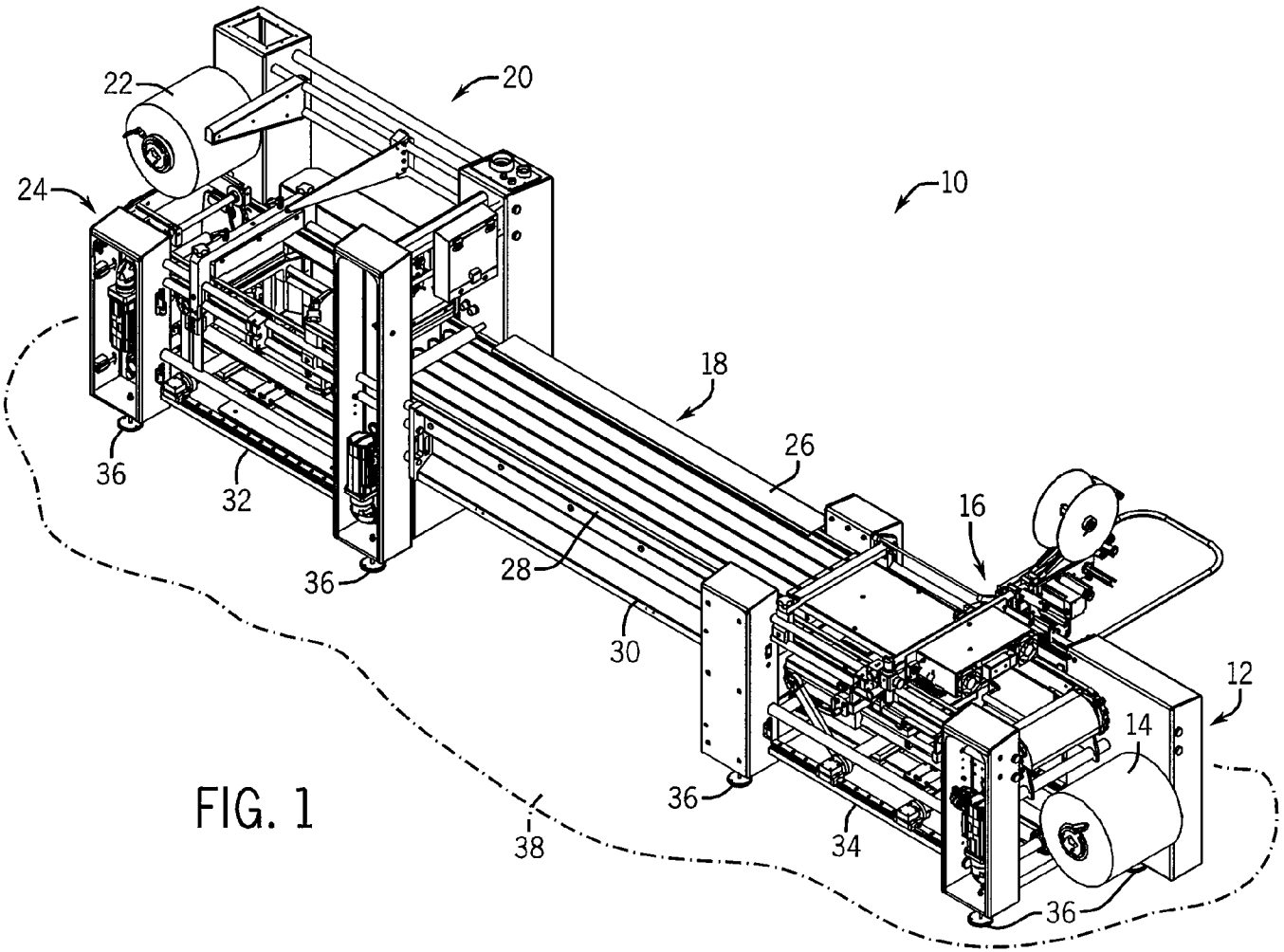
FIG. 1 is an isometric view of a food packaging system incorporating a mandrel brake according to one aspect of the invention.

FIG. 1 illustrates a food packaging machine 10 that generally includes a lower web supply station 12 for supplying a web of flexible web material from a supply roll 14 to a formation station 16. The web of flexible material is advanced to the formation station 16 at which cavities are formed in the web. The deformed web is then presented to a loading station 18 at which a user or machine loads products, e.g., hot dogs, cheese, etc., into the cavities formed in the sheet of web material. After product is loaded into the cavities, the sheet of web material is advanced to an upper web station 20 that supplies a web of flexible material from a supply roll 22. As is known in the art, the upper web of flexible material is placed atop the loaded cavities and the upper and lower webs of material is presented to a sealing station 24, which may evacuate the loaded cavities, and seals the upper and lower webs of material together. As is known in the art, the sealing station 24 may include a heating assembly that heats the webs of flexible material to seal the upper web to the lower web of flexible material. The sealed packages may then be presented to a cutting station (not shown), labeling station (not shown), and bulk packaging station (not shown) as generally understood in the art. As further known in the art, the packaging machine 10 may also include a display unit (not shown) that presents a touch screen, for instance, to allow a user to control the food packaging machine 10 while proximate the loading station 18. It is noted that the packaging machine 10 may include various doors and covers (not shown) to limit access to the various moving parts of the machine 10 as known in the art.

Figure 2:
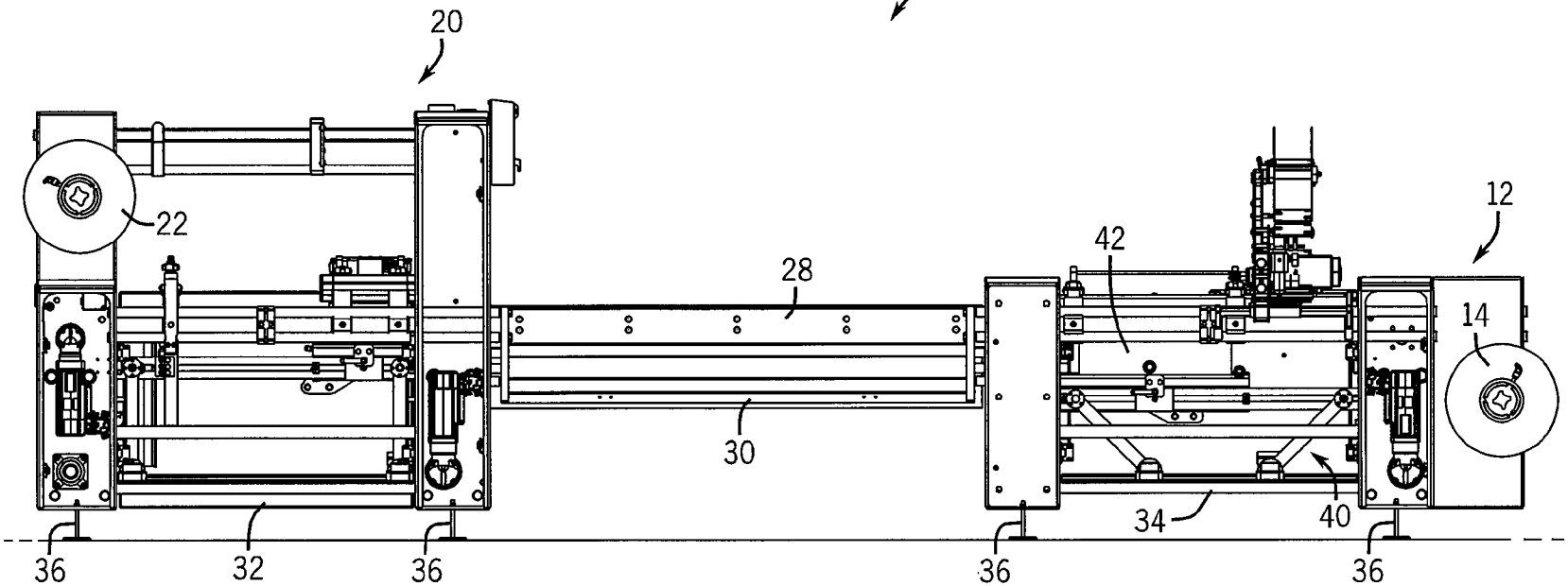
FIG. 2 is a front elevation view of the packaging system shown in FIG. 1.

With further reference to FIG. 2, the various components of the food packaging machine 10 are supported by a frame assembly that includes a pair of spaced parallel upper frame members 26, 28 and lower spaced frame members such as shown at 30, 32, and 34. Legs 36 support the frame members in a raised position above floor 38. In a preferred embodiment, the frame members are joined using a suitable adhesive, such as described in U.S. Ser. No. 12/246,915, the entire disclosure of which is incorporated herein by reference.

The formation station 16 includes a lift mechanism 40 that reciprocally moves a formation box 42 between a lowered position and a raised position. As known in the art, the formation box 42 has a set of dividers that define a set of cavities that may be evacuated using a vacuum (not shown) so as to draw the lower web material into the cavities. More particularly, when the formation box 42 is in its fully raised position, the formation box 42 contacts an underside of the lower web material. The cavities may then be evacuated to draw the lower web of flexible material downward into the cavities to form a deformed lower web of flexible material. It is recognized that stamps (not shown) may also be used to help force the lower web of flexible material into cavities so as to deform the lower web of flexible material. This process forms a number of cavities in the lower web that may be used for receiving product as described with respect to FIG. 1.

As known in the art, the formation box 42 is lowered and the deformed web material is advanced to the filling station 18 and thereafter to the finishing stations of the machine 10, such as the upper web station 20, the sealing station 24, and the cutting, labeling and bulk packaging stations. In this regard, the packaging machine 10 is similar to conventional packaging machines in that web material is advanced from a supply roll to the various stations. Typically, the sheet of web material is incremented or indexed at a predefined speed to allow sufficient time for each of the functions at the various stations to be carried out. As further known in the art, the upper and lower webs of material are generally advanced from their respective rolls 14, 22 by an advancement arrangement that, in one embodiment, includes a set of clamps that are carried by a belt as described in U.S. Ser. No. 12/057,916, the entire disclosure of which is incorporated herein. It is understood however that the machine 10 may be fitted with other types of advancement arrangements.

Figure 3:
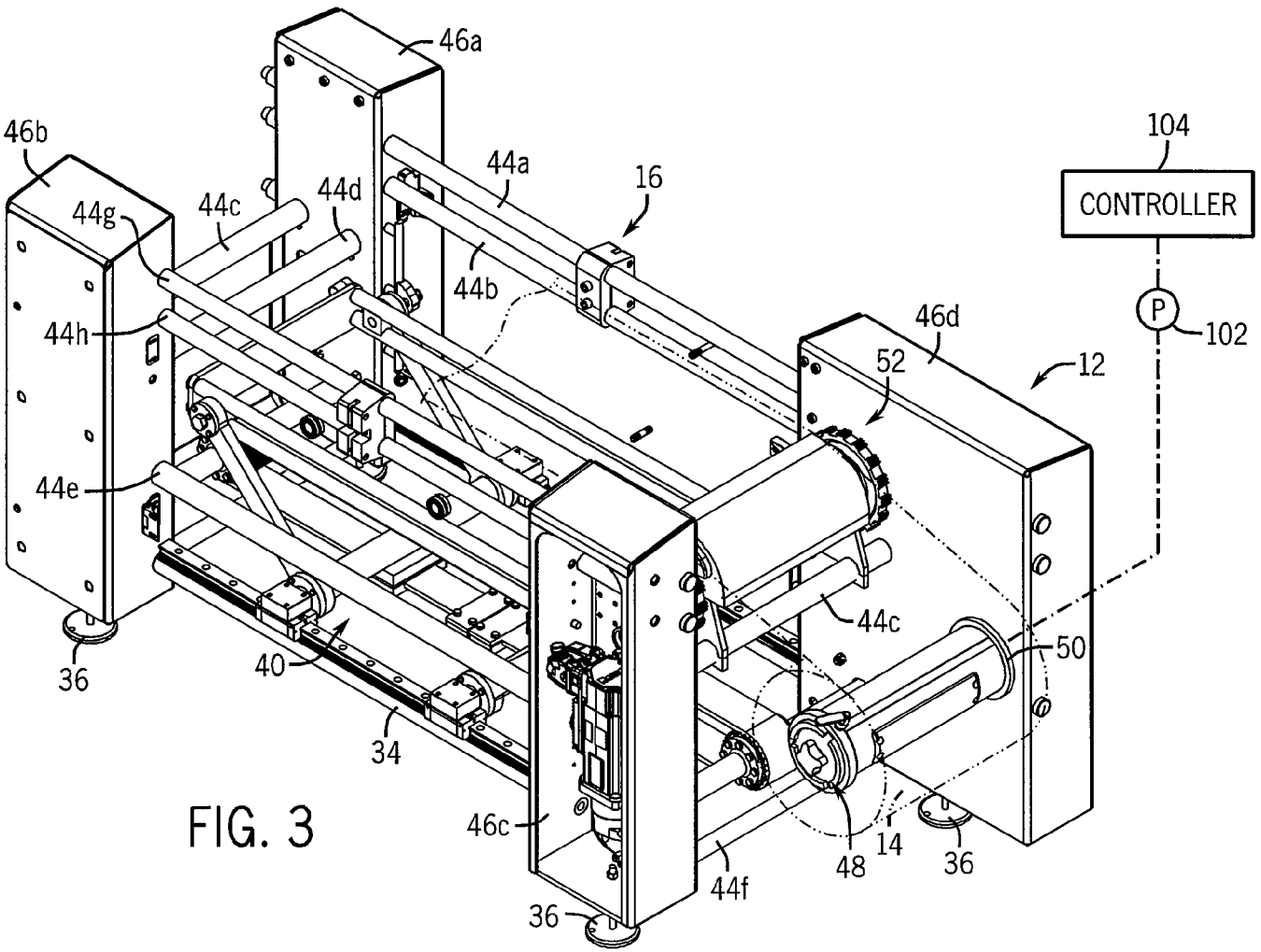
FIG. 3 is an enlarged isometric view of a formation station of the food packaging system of FIGS. 1 and 2, to which web material is fed by a web supply roll supported on a mandrel having a brake to impart tension on the web material.

Referring now to FIG. 3, the formation station 16 is generally defined by a number of tubular frame members 44*a*-44*i* that are connected to and extend between upright corner posts 46*a*-46*d*. As shown in the figure, the frame members 44*a*-44*i* and the posts 46*a*-46*d* provide structural support for the lift mechanism 40 as known in the art. In addition, the post 46*d* may be configured as a housing defining an interior within which the various electrical and pneumatic connections for the packaging machine 10 are made. The post 46*d* includes a structural frame to which a series of walls are mounted in order to form the housing defined by the post 46*d*.

As further shown in FIG. 3, post 46*d* provides support for the web supply roll 14. More particularly, the web supply station 12, of which post 46*d* may be considered a part, includes a mandrel 48 connected at an inner end 50 to the post 46*d*. The mandrel 48 is designed to be received within the hollow core of the roll of web material 14 and in a manner that allows the roll of web material 14 to rotate about the mandrel 48 as the web material is pulled from the supply roll 14. As shown in FIG. 3, in a preferred embodiment, the web material is presented directly to the advancement mechanism, generally designated by reference numeral 52, rather than passed through a set of dancer rolls or other tensioning mechanism.

Figure 4:
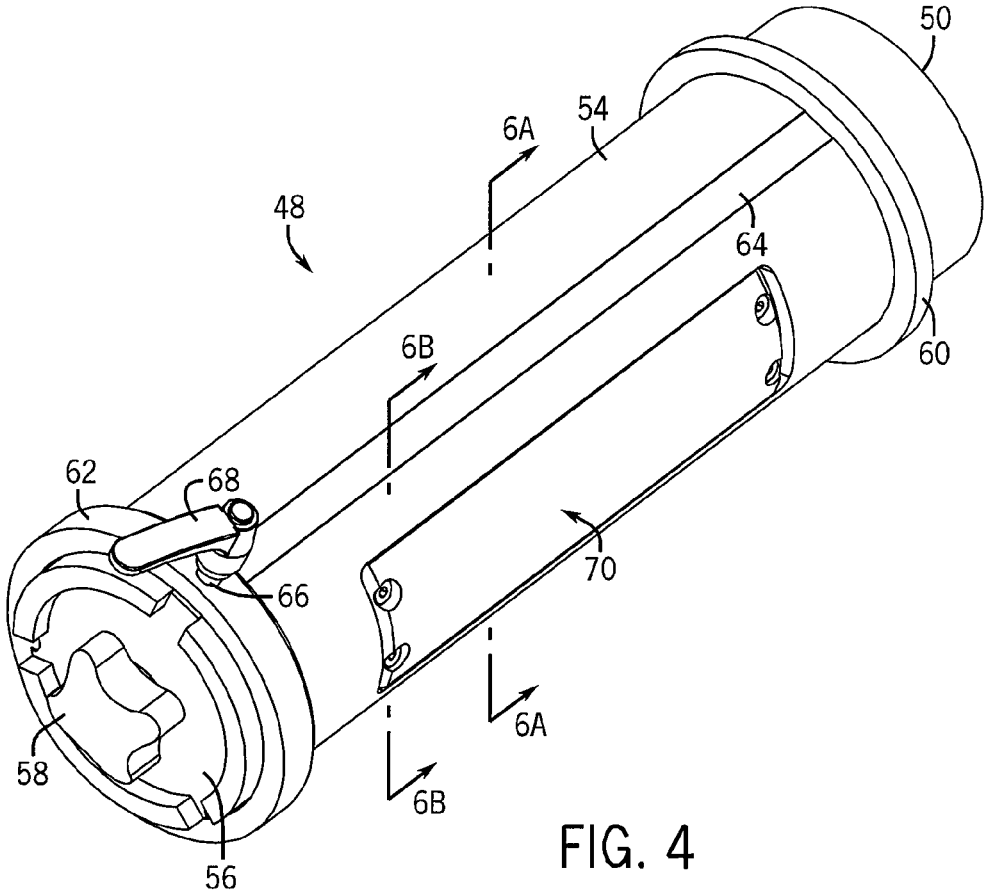
FIG. 4 is an isometric view of the mandrel shown in FIG. 3.

Turning to FIG. 4, the mandrel 48 generally consists of a cylindrical body 54 having the aforementioned inner end 50 that is coupled to the post 46*d* and an opposite outer end 56. In one embodiment, the mandrel 48 is removably mounted to the post 46*d*. In this regard, a rod (not shown) extends laterally from the post 46*d*. The cylindrical body 54 has a longitudinally extending bore (not shown) extending along its length between the ends 50, 56. As such, the cylindrical body 54 is slid over the rod such that the rod extends through the bore. Once the cylindrical body 54 is appropriately positioned onto the rod, a locking cap 58 may be secured, e.g., threaded, to the end of the rod thereby locking the mandrel 48 to the post 46*d* and securing the mandrel 48 against rotation.

The mandrel 48 further includes a guide arrangement generally consisting of a fixed ring 60 adjacent inner end 50 and a slidable ring 62 that may be spaced at various positions away from the fixed ring 60. In this regard, a groove 64 is defined in an outer surface of the cylindrical body 54 and generally extends between ends 50 and 56. The slidable ring 62 is locked in position along the length of the groove 64 by a set screw 66 that may be tightly seated in the groove 64 via rotation of a handle 68. In a preferred embodiment, multiple grooves may be formed in the outer surface of the body 54 to offer a user some flexibility in the position at which the slidable ring 62 is secured to the body 54.

The rings 60, 62 have an annular body that extends radially from the cylindrical body 54 and are thus raised relative to the cylindrical body 54 to function as a guide for a roll of web material loaded onto the mandrel 48. The aforementioned slidable ring 62 may be slid to vary the distance between the two rings 60, 62 to account for web supply rolls of different sizes. It will also be appreciated that the slidable ring 62 must be slid off the cylindrical body 54 to load a roll of web material onto the cylindrical body 54.

Figure 5:
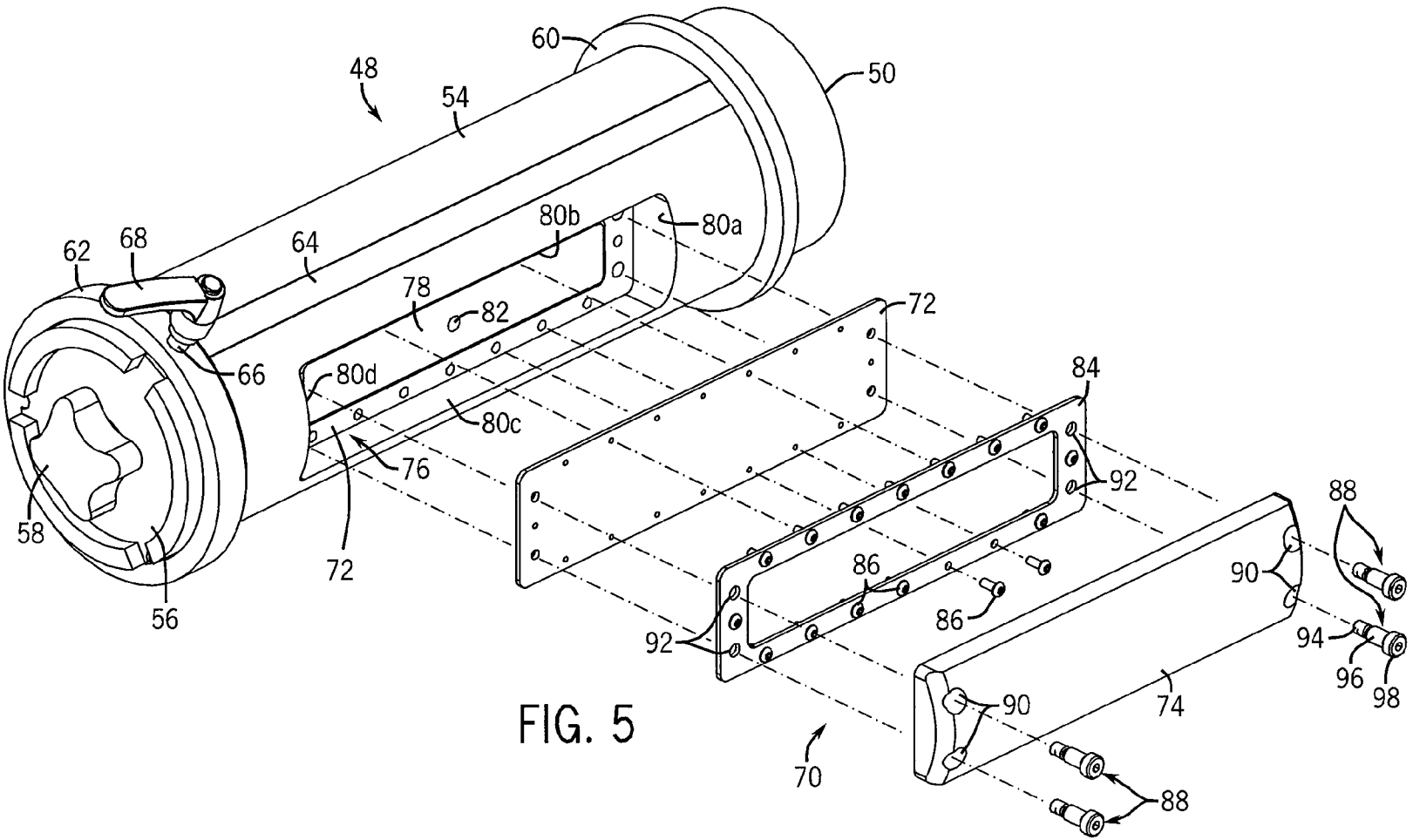
FIG. 5 is an exploded view of the mandrel shown in FIG. 4.

In accordance with the present invention, the mandrel 48 also includes a brake 70 that can be selectively activated to apply a braking force to the rotation of the roll of web material around the mandrel 48. The components of the brake 70 are shown in FIG. 5.

The brake 70 generally includes an inflatable bladder 72 and a shoe 74 that moves in a direction normal to the length of the cylindrical body 54 when the bladder 72 is sufficiently inflated. As shown in FIG. 5, the bladder 72 and the shoe 74 generally fit in a rectangular shaped recess 76 formed in the outer surface of the cylindrical body 54. In this regard, the recess 76 is defined by a generally planar back wall 78 and a series of sidewalls 80*a*, 80*b*, 80*c*, and 80*d*. A port 82 is defined in the planar back wall 78 and communicates with a fluid supply (not shown) that, as will be described, is used to selectively add or remove fluid from the bladder 72. The body 54 includes a nozzle (not shown) or other fitting that interfaces with the port 82 so that fluid can be added to or removed from the bladder 72. A retainer 84 fits over an outer edge of the bladder 72 and fasteners 86 are used to attach the ring 84 and the bladder 72 to the back wall 78 of the mandrel body 54 in a fluid-tight manner that allows the bladder 72 to inflate through the opening of retainer 84 as fluid is added thereto via port 82. The brake shoe 74 is then in turn fastened to the back wall 78 of the mandrel body 54 via fasteners 88 that extend through openings 90 in the shoe 74 and openings 92 in the retainer 84. The fasteners 88 generally include a threaded portion 94, a smooth portion 96, and a head 98. This construction allows a fastening tool (not shown) to be engaged with the head 98 in a known manner and rotated to thread the threaded portion 94 into engagement with threads (not shown) formed in body 54 in alignment with opening 92. The fastener 88 includes a shoulder that engages the retainer 84 adjacent opening 92 to assist in securing retainer 84 to mandrel body 54. The smooth portion 96 is received within a passage in mandrel body 54 in alignment with opening 90, and acts as a guide that allows the shoe 74 to slide in response to inflation of the bladder 72 without becoming detached from the mandrel body 54.

The brake 70 is designed to create tension in the sheet of web material as the sheet of web material is advanced by the advancement mechanism 52. More particularly, in one preferred embodiment, the advancement mechanism 52 pulls the sheet of web material from the supply roll 14 in an indexed manner (although it is understood that the brake 70 may also be used to retard the rate at which web material is unwound from a roll in a continuous manner). In this regard, the advancement mechanism 52 pulls the sheet of web material from the supply roll 14 for a predefined period of time so that a predefined length of web material is pulled from the supply roll 14. Near the end of the indexing cycle, fluid, e.g., air, is injected into the bladder 72 thereby causing inflation of the bladder 72. As the bladder 72 inflates, the shoe 74 is pushed outwardly away from the back wall 78 and into further engagement with the core of the web supply roll 14.

Figure 6A:
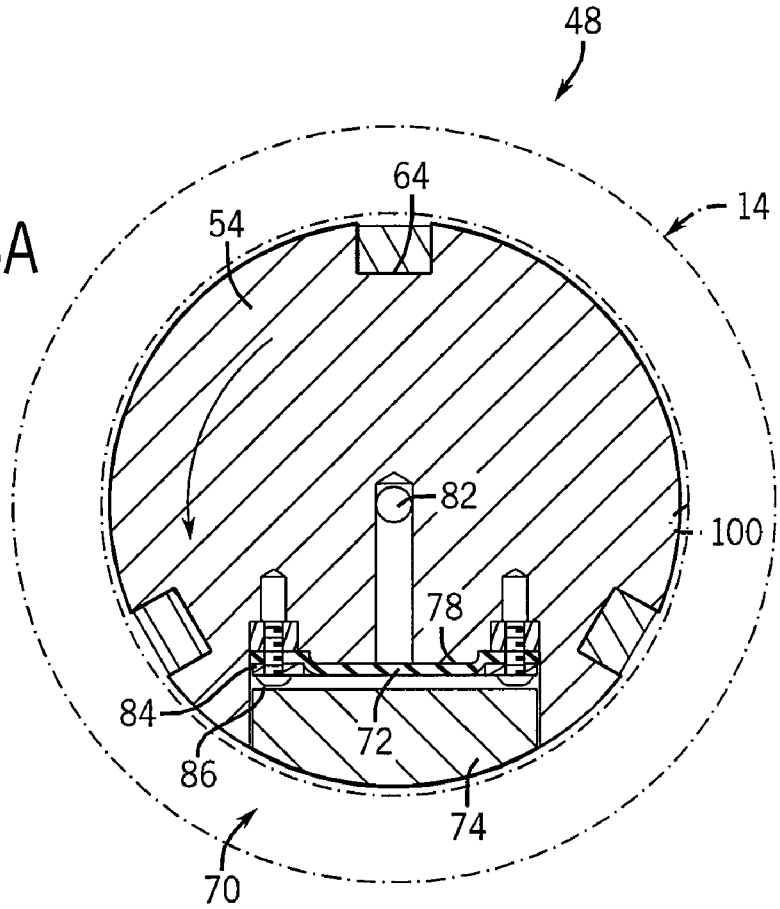
FIG. 6A is a section view of the mandrel taken along line 6A-6A of FIG. 4 and showing a bladder that can be selectively filled with air to apply a braking pressure to the web supply roll supported on the mandrel.
Figure 6B:
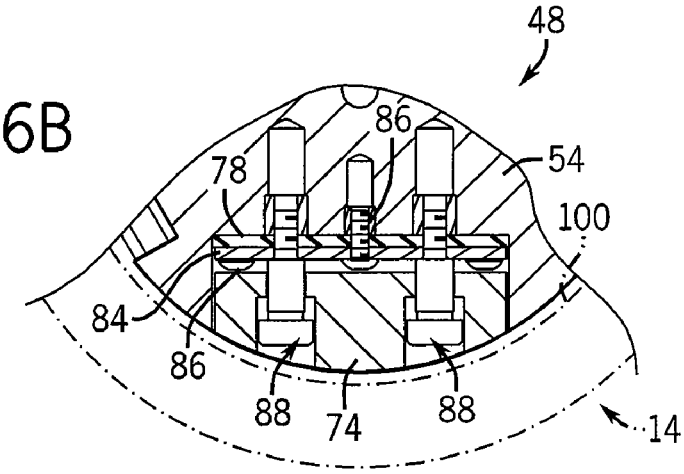
FIG. 6B is a section view of the mandrel taken along line 6B-6B of FIG. 4.
Figure 6C:
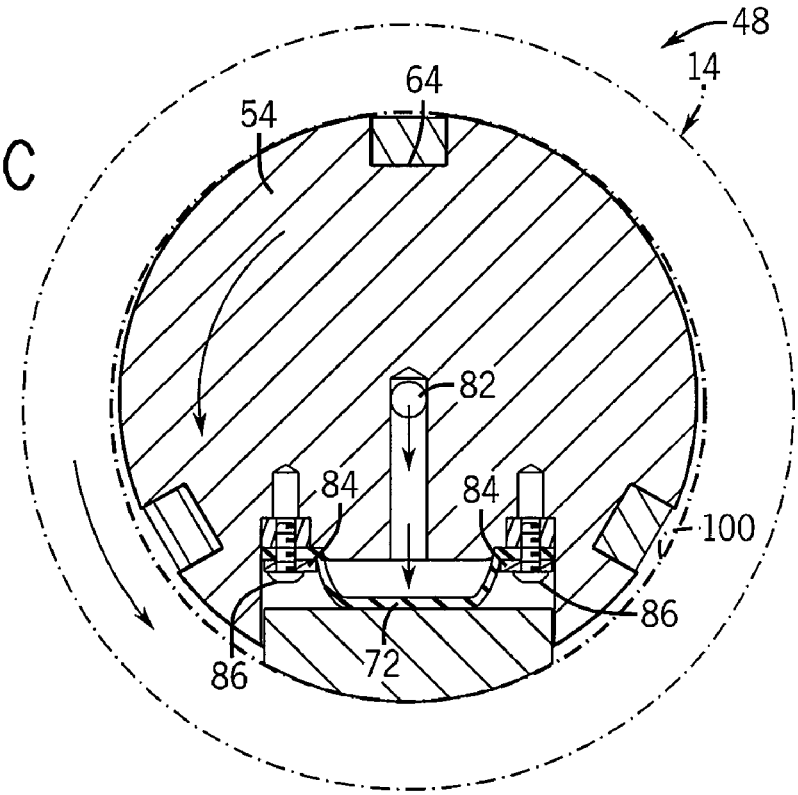
FIG. 6C is a section view similar to that shown in FIG. 6A with the pressure of the bladder increased to apply a braking force to the web supply roll.
Figure 6D:
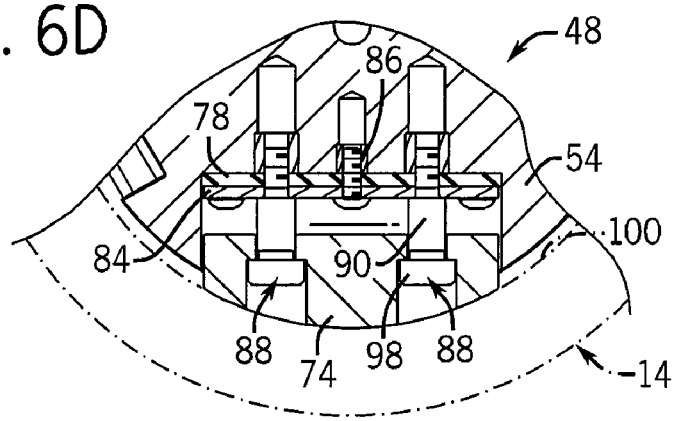
FIG. 6D is a section view similar to that shown in FIG. 6B with the pressure of the bladder increased to apply a braking force to the web supply roll.

In operation, during most of the indexing motion when the web material is being unwound, the bladder 72 is deflated or minimally inflated, e.g., maintained at a low pressure such as 5 p.s.i., and the shoe 74 is generally recessed in the recess 76 formed in the outer wall of the mandrel body 54, as shown in FIGS. 6A and 6B. In this position, the shoe 74 is generally spaced from the inner surface of the core 100 of the web supply roll 14. On the other hand, when the bladder 72 is inflated, e.g., maintained at a higher pressure such as 25-30 p.s.i., the shoe 74 is pushed into engagement with the core 100 of the web supply roll 14 to slow rotation of the web supply roll 14, as shown in FIGS. 6C and 6D. As further shown in FIG. 6D, the openings 90 formed in shoe 74 are recessed which allows the shoe 74 to slide along the smooth portion 90 of the fasteners 88. The linear range of motion is limited by the heads 98 of the fasteners 88.

Referring briefly to FIG. 3, the pressure in the bladder 72 is generally set by a pump 102 under the control of a controller 104 which may include various processors and software to control the packaging process such as the indexing time, etc., and the cyclical inflation and deflation of the bladder 72. In a preferred embodiment, the bladder 72 is air filled but is contemplated that other types of fluids may be used. One skilled in the art will appreciate that the pump 102 may be fluidly coupled to a fluid source, such as a pressurized tank (not shown).

As noted above, it is preferred that the bladder 72 be deflated to a pressure of approximately 5 p.s.i. to retract the shoe 74 and inflated to a pressure of approximately 25-30 p.s.i. to fully extend the shoe 74 into contact with the core 100 of the web supply roll. It will be appreciated that engagement of the shoe 74 against the inner surface of the core 100 slows or counters the pulling force the advancement mechanism places on the supply roll 14 as the advancement mechanism pulls the sheet from the supply roll. By applying the braking force before the indexing cycle is complete, continued advancement of the advancement mechanism will be countered thereby placing tension on the sheet of web material as the advancement mechanism advances to its position at the completion of the indexing cycle. In this regard, tension is created in the sheet of web material without passing the sheet through dancer rolls or other intermediary component. Before the next indexing cycle, the bladder 72 is deflated to allow the advancement mechanism to advance the sheet of web material without any (or at least reduced) tension.

It should be understood that the bladder 72 may be inflated to varying degrees of pressure to provide a desired degree of tension on the web of material as the web is being unwound from the core 100. For example, the bladder 72 may be partially inflated to provide relatively soft resistance to rotation of the supply roll 14 during a portion of the unwind cycle, and may thereafter be more fully inflated to increase the resistance to rotation of the supply roll 14 during another portion of the unwind cycle. The pressure is maintained in the components that fluidly interconnect the pump 102 and the bladder 72, so that alterations in the pressure in bladder 72 can quickly be achieved.

Various alternatives and embodiments are contemplated as being within the scope of the following claims particularly pointing out and distinctly claiming the subject matter regarded as the invention.

I claim:

1. A web supply arrangement for use with packaging machine that uses web material, the arrangement comprising:

a roll having web material wound around a hollow core;

a mandrel adapted to be received within the hollow core of the roll and configured to support the web material;

a variable speed advancement arrangement engaged with the web material, wherein the variable speed advancement arrangement includes a web engagement mechanism that advances the web material through the packaging machine in a cyclic intermittent motion indexing manner;

an inflatable device associated with the mandrel, wherein the inflatable device is selectively inflatable to brake rotation of the roll and to thereby control the tension of the web material as the web material is unwound from the roll of web material during cyclic indexing advancement of the web material through the packaging machine;

a pump for selectively inflating the inflatable device; and a controller interconnected with the pump and responsive to the variable speed advancement arrangement, wherein the controller is operable to control a pressure in the inflatable device in response to the variable speed advancement arrangement, wherein operation of the controller to control pressure in the inflatable device functions to cooperate with the variable speed advancement arrangement to control tension of the web material between the roll and the web engagement mechanism and to vary tension in the web material within each cycle of movement of the web material caused by the variable speed advancement arrangement.

2. The arrangement of claim 1, wherein the controller operates the pump to provide a first, relatively low pressure in the inflatable device at the initiation of an indexing advancement cycle by the variable speed advancement arrangement, and to increase pressure in the inflatable device during progression of the indexing advancement cycle to provide a second, relatively high pressure in the inflatable device toward the end of the indexing advancement cycle, wherein the second, relatively high pressure in the inflatable device creates tension in the web material when advancement of the web material is stopped by the variable speed advancement arrangement at the end of the advancement cycle.

3. The arrangement of claim 2 wherein the inflatable device includes an inflatable bladder and a shoe movably attached to the mandrel, wherein the shoe is pushed away from the mandrel by the bladder toward the hollow core of the roll of web material when the bladder is inflated by the pump.

4. The arrangement of claim 3 wherein the shoe is engaged with the mandrel via a movable connection that enables inward and outward movement of the shoe in response to inflation and deflation of the bladder.

5. The arrangement of claim 3, wherein the bladder comprises a resilient planar member that overlies a recess defined by the mandrel that receives pressurized fluid from the pump, and further comprising a ring coupling an outer area of the bladder to the shaft such that an inner area of the bladder extends through an opening defined by the ring when the bladder is inflated.

6. The arrangement of claim 3, further comprising a recess in an outer surface of the mandrel and wherein the bladder is positioned over the recess.

7. The arrangement of claim 2 wherein the mandrel comprises a cylindrical member and a guide arrangement mounted to an outer surface of the cylindrical member, wherein the guide arrangement is configured to axially align the hollow core along the cylindrical member.

8. The arrangement of claim 7 wherein the guide arrangement includes a first ring member and a second ring member spaced from the first ring member for receiving the roll therebetween.

* * * * *